US005825405A

United States Patent [19]

Puritscher et al.

[11] Patent Number: 5,825,405

[45] Date of Patent: Oct. 20, 1998

[54] TRANSFER PRINTING STATION FOR PARALLEL PROCESSING OF TWO RECORDING MEDIUM WEBS

[75] Inventors: Ernst Puritscher, Unterhaching; Gerhard Klapettek, Giessen, both of Germany

[73] Assignee: Oce Printing Systems GmbH, Poing, Germany

[21] Appl. No.: 776,182

[22] PCT Filed: Jul. 19, 1995

[86] PCT No.: PCT/DE95/00952

§ 371 Date: Jan. 22, 1997

§ 102(e) Date: Jan. 22, 1997

[87] PCT Pub. No.: WO96/03283

PCT Pub. Date: Feb. 8, 1996

[30] Foreign Application Priority Data

Jul. 22, 1994 [DE] Germany ..... 44 26 124.1

[51] Int. Cl.[6] ..... B41J 2/47

[52] U.S. Cl. ..... 347/262; 347/153

[58] Field of Search ..... 347/262, 264, 347/153, 154, 139

[56] References Cited

U.S. PATENT DOCUMENTS 4,494,855 1/1985 Colwill ..... 355/1
4,974,979 12/1990 Cardenas .
5,018,887 5/1991 McCray et al. .

FOREIGN PATENT DOCUMENTS 0 197 340 10/1986 European Pat. Off. .
0 391 693 10/1990 European Pat. Off. .
32 11 492 12/1982 Germany .
33 07 583 9/1983 Germany .
405 861 7/1966 Switzerland .
2 224 999 5/1990 United Kingdom .

OTHER PUBLICATIONS

K. Sanders, "Two–Path Electrophotographic Print Process", IBM Technical Disclosure Bulletin, vol. 22, No. 6, Nov. 1979.

Japanese Abstract, vol. 10, No. 70, (M–462), Mar. 19, 1986, 60–214980, Oct. 28, 1985.

*Primary Examiner*—Mark J. Reinhart
*Attorney, Agent, or Firm*—Hill & Simpson

[57] ABSTRACT

In a printing station, pins for engaging edge perforations of the paper are mounted on a toothed belt. The paper is lifted from a position fully engaged on the pins to a tapered head portion of the pins higher up on the pins to avoid stress on the paper from the pins. Lifting of the paper is provided by a paper guide element.

4 Claims, 4 Drawing Sheets

TRANSFER PRINTING STATION FOR PARALLEL PROCESSING OF TWO RECORDING MEDIUM WEBS

BACKGROUND OF THE INVENTION

1. Field of the Invention

The present invention relates generally to a paper transport for a printing station, and more particularly to an arrangement of pins for engaging into edge perforations of continuous paper to move the paper through the printer.

2. Description of the Related Art

It is standard to employ what is referred to as a tractor drive for the transport of margin-perforated recording media in the region of the transfer printing station of electrographic printer devices. Such a tractor drive is disclosed, for example, by German patent document DE-C2-3307583. The known tractor drive contains a toothed belt that runs over a drive pulley and a deflection pulley. Dog pins that engage into the margin perforations of the recording medium for transporting the band-shaped recording medium are mounted laterally at the toothed belt via holders.

So that the dog pins can easily enter into the perforation holes and slide therefrom in turn during the rotation of the pulleys, it was also proposed according to the illustration of FIG. 2 to guide the recording medium 10 under the neutral fiber 30 of the belt 26.

An electrographic printer device disclosed in the earlier European Patent Application 93108219.2 is designed for printing band-shaped recording media with different band widths in different operating modes such as single-color and multicolor simplex printing, single-color and multicolor duplex printing and for simultaneously printing two recording medium webs in parallel operation. To this end, the units of the printer device such as an intermediate carrier, a transfer printing station and fixing station have a usable width of at least twice the band width of a narrow recording medium. The printer device also contains a deflection means that follows the fixing station that can be connected in as needed and that has an allocated return channel to the transfer printing station via which the recording media can be turned over in single-color or multicolor duplex mode and resupplied to the transfer printing station.

Due to the employment of two recording medium webs in the parallel operation, two tractor drives must be arranged parallel next to one another in the region of the transfer printing station. Since the transfer printing region, including the transfer corotron, extends continuously over two recording medium webs, it is necessary to keep the unusable gap between the recording medium webs and, thus, between the tractor drives optimally small. A lateral arrangement of the dog pins next to the belt according to the illustration of FIG. 2 would enlarge the gap.

When, according to the illustration of FIG. 3, however, the dog pins are arranged on the outer circumferential surface of the belt, the recording medium is at a great distance from the neutral fiber. The spacing of the dog pins thus varies considerably when rolling over the pulley, this leading to damage to the perforation holes.

The European patent document EP-A2-0 391 693 discloses a tractor drive with a toothed belt having pins centrally arranged thereon for a margin-perforated recording medium in an impact printer via which a single recording medium web is conveyed through the printer. A ramp that lowers the toothed belt and, thus, the pins comprising a collar and a conically tapering tip relative to the recording medium before the pulley is arranged between the actual transport region and a pulley that drives the toothed belt. Upon rotation around the pulley, the pins thus glide from the transport holes without damaging them.

SUMMARY OF THE INVENTION

It is therefore an object of the invention to provide a transfer printing station for an electrographic printer device that makes it possible to convey two parallel recording medium webs composed of recording media provided with margin perforations arranged in close proximity next to one another through the transfer printing station and print them in parallel. The transfer printing station should thereby be able to reliably process recording media of different tearing resistance with high line alignment precision.

This object is achieved by a transfer printing station for an electrographic printer or copier device that is designed for parallel printing of two recording medium webs comprising margin perforations that are guided next to one another in close proximity in the region of the transfer printing station and that comprises a conveyor means that transports the recording medium webs through the transfer printing station in parallel, with endless belts arranged in the region of the margin perforations of the recording medium webs that are guided over axially spaced, motor-driven pulleys, dog pins arranged on the outside circumferential surface of the belts, the dog pins comprising a cylindrical collar which is adjoined by a tapering head part, whereby, for conveying the recording medium webs, the dog pins engage into the margin perforations of the recording medium up into the region of their collar in the region of a conveying path between the pulleys, recording medium positioning devices arranged in the region of the pulleys that guides the recording medium upon engagement and disengagement of the dog pins during the rotation of the pulleys in the region of the head part of the dog pins such that the margin perforations are not deformed, whereby the recording medium positioning devices comprise: a guide element that lifts the recording medium in the region of the pulleys, and a supporting means that supports the belt in the region of the conveying path between the pulleys and that has allocated hold-down elements for the recording medium.

Advantageous developments of the invention are provided by the belt is fashioned as toothed belt on which the dog pins are secured via clamps that embrace the belt.

When tractor drives are employed in the transfer printing station wherein the transport pins are arranged on the outside surface of the belts and the recording medium is lifted in the admission region to the belt wheel up into the region of the tapering head part of the transport pins, two recording medium webs can be transported in close proximity through the transfer printing station and printed without damage to the recording medium webs.

The displacement of the recording medium can ensue in a simple way via a paper guide element over which the recording medium runs. However, it is also possible to retain the paper running and corresponding lower the transport pins, for example with a change in position of the pulley.

BRIEF DESCRIPTION OF THE DRAWINGS

Embodiments of the invention are shown in the drawings and are described in greater detail below. Shown are.

DETAILED DESCRIPTION OF THE PREFERRED EMBODIMENTS

Figure 1:
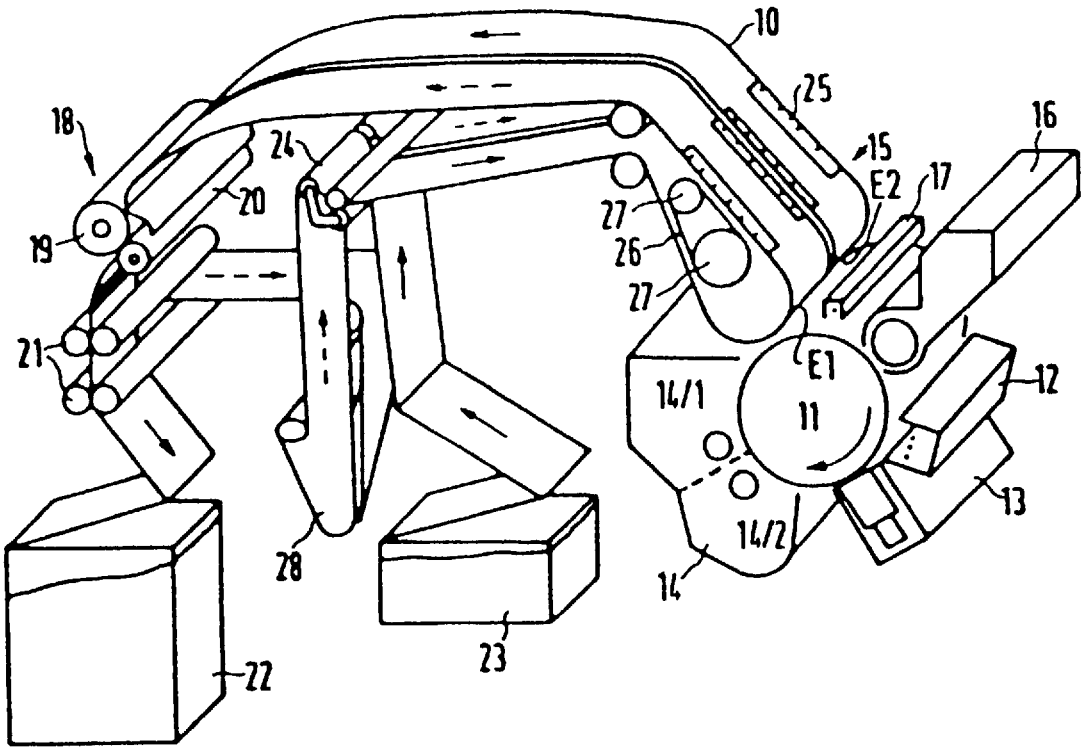
FIG. 1 is a schematic illustration of an electrographic printer device with two recording medium webs with tractor drive arranged in close proximity next to one another in the region of the transfer printing station.

An electrographic printer device for printing band-shaped recording media 10 with different band widths contains an electromotively driven photoconductor drum an intermediate carrier 11. Instead of the photoconductor drum, however, a band-shaped intermediate carrier, for example an OPC band, or a magneto-styli arrangement as disclosed, for example, by European patent document EP-B1-0 191 521 can also be employed. The various units for the electrophotographic process are grouped around the intermediate carrier 11. These are essentially: a charging means 12 in the form of a charging corotron for charging the intermediate carrier; a character generator 13 with a light-emitting diode comb for the character-dependent exposure of the intermediate carrier 11 that extends over the entire usable width of the intermediate carrier 11; a developer station 14 for inking the character-dependent charge image on the intermediate carrier 11 with the assistance of a one-component or two-component developer mixture; a transfer printing station 15 that extends over the width of the intermediate carrier 11 and with which the toner images are transferred onto the recording medium 10. A cleaning station 16 with a cleaning brush integrated therein with an appertaining extraction means as well as a discharge means 17 is provided for removing the residual toner after the developing and the transfer printing. The intermediate carrier 11 is electromotively driven and is moved in the direction of the arrow during the printing mode.

The printer device also contains a fixing station following the transfer printing station 15 in a conveying direction of the recording medium, this fixing station 18 being fashioned as a thermoprinting fixing station having a heated fixing drum 19 with an appertaining pressure drum 20 as well as guide rollers 21 following the fixing station that, among other things, serve as output elements for a stacker means 22 for the recording medium 10. Other fixing stations, for example with a heated or unheated admission saddle or a cold fixing station are also possible instead of the illustrated fixing station. The band-shaped recording medium 10 is fabricated as pre-folded continuous stock provided with margin perforations and is supplied to the transfer printing station via delivery rollers 24 proceeding from a supply region 23.

The transport of the recording medium thereby preferably ensues via a conveyor means 25 allocated to the transfer printing station in the form of conveyor belts 26 provided with pins 32 that, guided over pulleys in the form of toothed disks 27, engage into the margin perforations 31 of the recording medium 10. Further, a deflection means 28 via which the recording medium 10 is returned from the fixing station 18 to the transfer printing station 15 is arranged in the housing region of the printer device between a supply region 23 and the fixing station 8.

The electrographic printer device is suitable for printing recording media having different band widths. To this end, the intermediate carrier 11 (photoconductor drum) comprises a usable width that corresponds to the greatest possible recording medium width (for example, a format of DIN A3 crosswise). This width corresponds to twice the DIN A4 band width. It is thus possible to arrange two recording medium webs E1 and E2 with a width corresponding to DIN A4 longitudinally next to one another in the region of the transfer printing station 15. The fixing station 18 and the other electrophotographic units such as a developer station 14, character generator 13, cleaning station 16 are designed according to this usable width.

An adaptation of the width of the character generator 13 to different recording medium widths requires no mechanical modification at the character generator when, as in this case, an LED character generator having a plurality of LEDs arranged in rows is employed. An adaptation to the width of the recording medium employed ensues electronically by drive.

Figure 2:
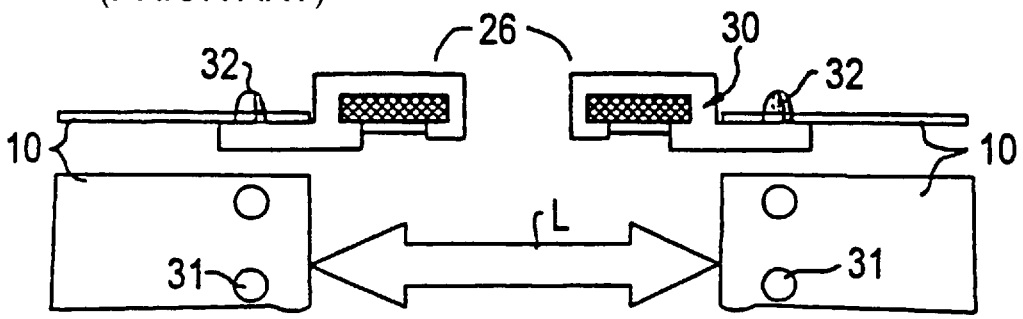
FIG 2 (PRIOR ART)
FIG. 2 is a schematic illustration of a known tractor drive with dog pins guided next to the belt.

As a result of employing two recording medium webs E1 and E2 in parallel operation, two tractor drives 25 must be arranged parallel next to one another in the region of the transfer printing station 15. Since the transfer printing region 15—including the transfer corotron—extends continuously over the two recording medium webs E1 and E2, it is necessary to keep the unusable gap L between the recording medium webs E1 and E2 and, thus, between the tractor drives as small as possible. A lateral arrangement of the dog pins 32 next to the belt 26 corresponding to the illustration of FIG. 2 would enlarge the gap L.

Figure 3:
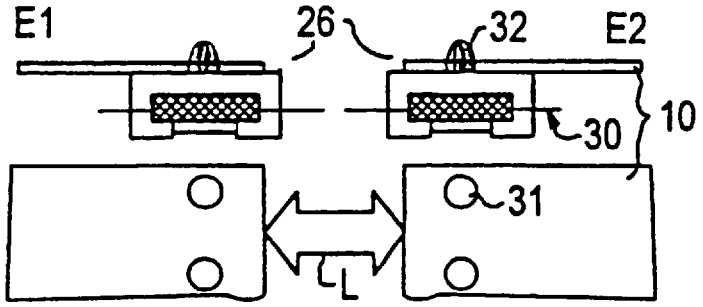
FIG. 3 is a schematic illustration of a tractor drive with dog pins arranged on the outside surface of the belt.

When, however, the dog pins are arranged on the outer circumferential surface of the belt 26, corresponding to the illustration of FIG. 3, then the recording medium 10 is at a considerable distance from the neutral fiber 30. The spacing of the dog pins thus varies considerably when rolling over the pulley 27, which leads to damage to the perforation holes. The dog pins 32 are thereby composed of steel. They have a cylindrical collar 33 which is joined by a tapering head part 34. The recording medium 10 is conveyed via the cylindrical collar 33. The tapering head part 34 serves as a threading element.

Figure 4:
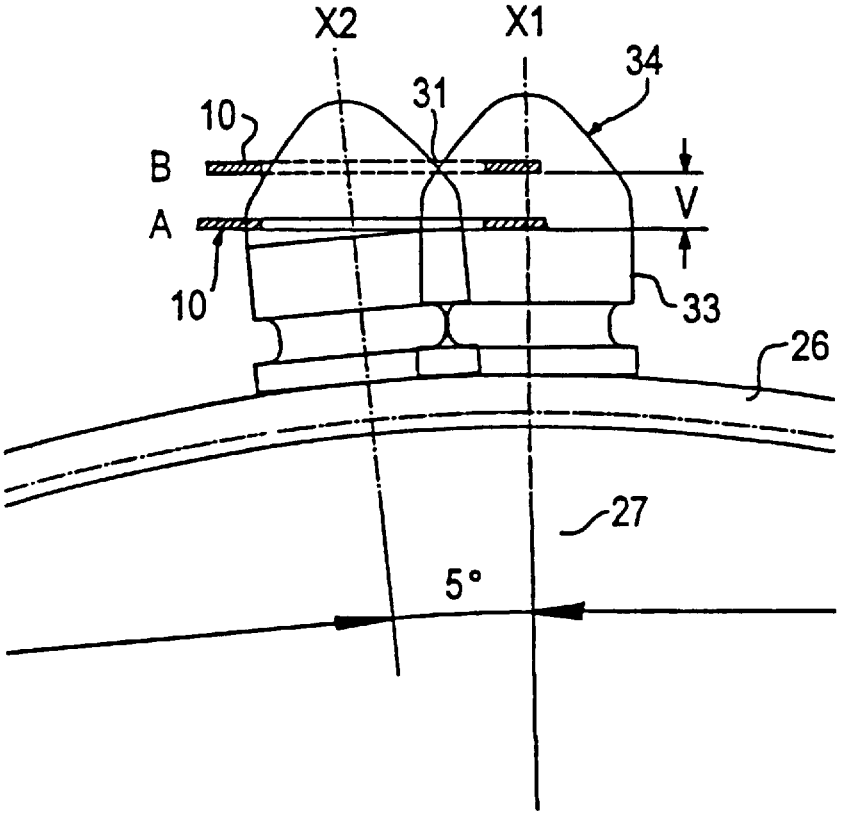
FIG. 4 is a schematic illustration of the effect of a lifting of the recording medium in the region of the pulleys.

In order to avoid this widening or, respectively, stretching of the perforation holes 31 that has a very negative effect on the paper running, the recording medium 10 is shifted or, respectively, lifted to such an extent from the transport position A in the region of the pulley 27 that, corresponding to the illustration of FIG. 4, the perforation holes 31 are located in a roll-off position B in the region of the tapering head part 34. The size of the displacement V is dependent on, among other things, the radius of the pulley 27, the thickness of the belt and the transport attitude of the recording medium. It is to be adapted such dependent on these parameters that the perforation holes glide along the pin walls at a slight distance therefrom when the pins engage and disengage during the roll-off event without having a significant pressure force acting against the perforation wall. In FIG. 4, X1 indicates the position of the pin 32 in an initial position and X2 indicates the position of the pin 32 after a revolution of the pulley 27 by 50. It can be seen therefrom that the collar 33 would deform the wall without upward displacement of the perforation hole 31.

The actual propulsion for the recording medium ensues in the straight conveying region of the pin guidance between the pulleys. The pins should be able to glide freely in the perforation holes in the region of the pulleys themselves.

Figure 5:
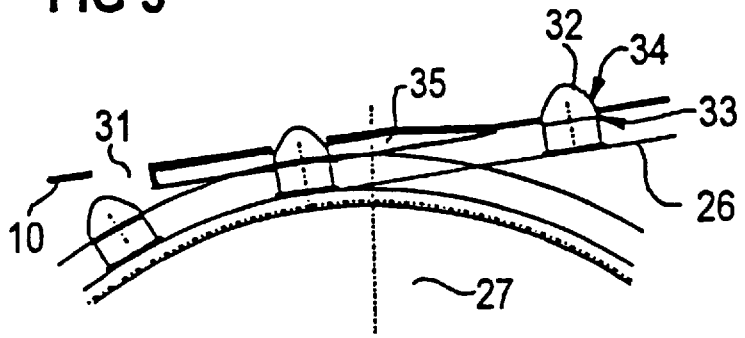
FIG. 5 is a schematic, excerpted view of a guide element that lifts the recording medium in the region of the pulleys.
Figure 6:
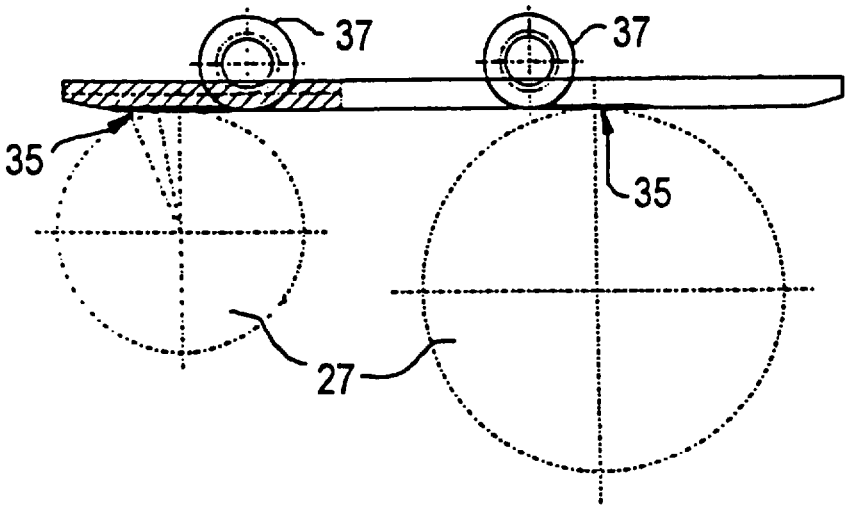
FIG. 6 is a schematic illustration of a tractor drive with guide elements.

In order to undertake the lifting of the recording medium 10 in a simple way, a paper guide element 35 is arranged in the region of the pulleys according to FIGS. 5 and 6. This paper guide element 35 extends into the straight region (conveying distance) of the pin guidance and lifts the recording medium by, for example, approximately 1 mm. A supporting means in the form, for example, of a hold-down means that supports the belt 26 in the conveying region between the pulleys 27 comprises hold-down elements 37 for the recording medium 10 preceding and following the paper guide element 35. These can be composed of rollers or of baffles or the like.

The belt itself is fashioned, for example, as a fiberglass reinforced toothed belt on which the dog pins 32 are secured via plastic clamps 38 that embrace the belt 10.

Although other modifications and changes may be suggested by those skilled in the art, it is the intention of the inventors to embody within the patent warranted hereon all changes and modifications as reasonably and properly come within the scope of their contribution to the art.

We claim:

1. A transfer printing station for an electrographic printer or copier device for parallel printing of two recording medium webs having margin perforations that are guided next to one another in close proximity in a region of a transfer printing station and that includes a conveyor means that transports the recording medium webs through the transfer printing station in parallel, comprising:

endless belts arranged in a region of the margin perforations of the recording medium webs, axially spaced, motor-driven pulleys over which said endless belts are guided, dog pins arranged on an outside circumferential surface of the endless belts, said dog pins including a cylindrical collar which is adjoined by a tapering head part, whereby, for conveying the recording medium webs, said dog pins engage into the margin perforations of the recording medium up in to a region of said collar in a region of a conveying path between the pulleys, recording medium positioning devices arranged in a region of the pulleys that guides the recording medium upon engagement and disengagement of the dog pins during the rotation of the pulleys in a region of the head part of the dog pins such that the margin perforations are not deformed, the recording medium positioning devices include:

a guide element that lifts the recording medium in a region of the pulleys from a position with said margin perforations about said cylindrical collars to a position engaging said tapered head part as the recording medium travels over said pulleys, and a supporting means that supports the endless belt in a region of the conveying path between the pulleys and that has allocated hold-down elements for the recording medium.

2. A transfer printing station according to claim 1, wherein the belt is a toothed belt on which the dog pins are secured via clamps that embrace the endless belt.

3. Transfer printing station according to one of the claims 1 or 2, having a supporting means (36) that supports the belt in the region of the conveying path between the pulleys and that has allocated hold-down elements (37) for the recording medium.

4. Transfer printing station according to any one of claims 1 through 3, whereby the belt (26) is fashioned as toothed belt on which the dog pins (32) are secured via clamps (38) that embrace the belt.

* * * * *